US006285333B1

(12) United States Patent
Reed et al.

(10) Patent No.: US 6,285,333 B1
(45) Date of Patent: Sep. 4, 2001

(54) METHOD AND APPARATUS FOR CHANGING THE ELECTRICAL CHARACTERISTICS OF AN ANTENNA IN A COMMUNICATIONS SYSTEM

(75) Inventors: John Douglas Reed, Arlington; Steven Thomas Dunbar, Haltom City, both of TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/315,468

(22) Filed: May 20, 1999

(51) Int. Cl.[7] ..... H01Q 13/10
(52) U.S. Cl. ..... 343/767; 343/768; 343/850
(58) Field of Search ..... 343/767, 768, 343/850; H01Q 13/10

(56) References Cited

U.S. PATENT DOCUMENTS 4,509,053 * 4/1985 Robin et al. ..... 343/767
5,589,840 * 12/1996 Fujisawa ..... 343/718
5,754,143 * 5/1998 Warnagiris et al. ..... 343/767
6,034,644 * 3/2000 Okabe et al. ..... 343/746

OTHER PUBLICATIONS

Published by the Institution, Savoy Place, London, W.C.2, "The Proceedings of The Institution of Electrical Engineers"; Part B vol. 102, 1955; pp. 211–218.

* cited by examiner

*Primary Examiner*—Hoanganh Le
(74) *Attorney, Agent, or Firm*—Mario J. Donato, Jr.; L. Bruce Terry; Charles W. Bethards

(57) ABSTRACT

A method and apparatus for changing the electrical characteristics of an antenna in a communications system includes first and second conductive portions separated by a slot. Circuit elements are coupled between the first and second conductive portions, the circuit elements being operably controlled by a bias current to control flow of RF current within the first and second conductive elements, wherein the path of the RF current is directed to be in substantially different locations within the first and second conductive elements.

15 Claims, 3 Drawing Sheets

METHOD AND APPARATUS FOR CHANGING THE ELECTRICAL CHARACTERISTICS OF AN ANTENNA IN A COMMUNICATIONS SYSTEM

FIELD OF THE INVENTION

The present invention generally relates to radio frequency communications systems and, more particularly, to a method and apparatus for changing the electrical characteristics of an antenna in a communications system.

BACKGROUND OF THE INVENTION

Radio frequency (RF) communications systems incorporate antennas at the transmitter and receiver to enable efficient transfer of RF signals propagating through space from the transmitter to the receiver. The transmitted signal generally propagates in a uniform way such as in a straight line unless there are obstructions along the path, like building clutter, or other man made or natural obstructions. When a cluttered environment is present, any number of reflections and diffractions may occur as the signal interacts with the environment. A receive antenna may collect a large number of signals in such an environment, the first arriving signal having traveled the shortest distance, and later arriving signal having traveled additional distance due to the signal path reflecting off a building, or diffracting around a corner. When these numerous signals sum together at the receive antenna, variations in amplitude occur caused by the phases and amplitudes of the signals in combination. This variation in amplitude is called fading. In the wireless environment, Rayleigh or Rician fading is well known in the art.

In a communication system, diversity reception is usually desired to combat fading, but the limitations of subscriber units often makes it difficult or impossible to implement diversity within the constraints involved. In mobile and portable subscriber units with a single antenna, the effect of fading requires additional signal strength to be sent compared to what is required when diversity antennas are used to achieve the same level of performance. This extra signal strength reduces the effective coverage area of the subscriber unit. In an environment where the wireless terminal is fixed, the fading problem may be worse, since the fixed terminal is mounted to a building or otherwise fixed and if a fade occurs, the fade may last for a long time. This is typically not the case with mobile units or portable units, which move around and therefore move in and out of fades very quickly, even if travelling at slow speeds.

In order to combat fading, antenna diversity is often used. Antenna diversity typically incorporates two or more antennas physically separated in space to avoid fades or nulls on a given antenna or branch. This may be accomplished by a number of different diversity techniques which are well known in the art, such as: combining, selecting or switching. These diversity techniques allow the signals on the antennas that are not experiencing fades to be used in whole or in part, and the antennas receiving the signal that are in a fade to be used to a lesser extent, or not at all.

Diversity generally requires two separate and distinct antennas from which the best signal, and correspondingly the best antenna, is chosen by various known diversity methods. This implies two antenna elements, two RF cables, and an electronic switch in the simplest diversity technique. In many cases, the expense of providing a diversity function is too high, particularly in subscriber units, where space, parts count, and constraints due to the structure of the handset make it difficult to incorporate multiple antenna elements. Thus there is a need for an improved antenna apparatus that removes the limitations of the prior art.

BRIEF DESCRIPTION OF THE DRAWINGS

The novel features believed characteristic of the invention are set forth in the appended claims. The invention itself, however, as well as a preferred mode of use, further objects, and advantages thereof, will best be understood by reference to the following detailed description of an illustrative embodiment when read in conjunction with the accompanying drawings, wherein:

DETAILED DESCRIPTION OF THE INVENTION

Stated generally, an antenna comprises a conductive element including a feed network coupled thereto. Circuit elements are coupled to the conductive element at predetermined positions. The circuit elements are adapted to control RF current flow in the conducting element, wherein the path of the RF current is directed to be in substantially different locations within the conductive element.

In addition, an antenna comprises first and second conductive portions separated by a slot. Circuit elements are coupled between the first and second conductive portions, the circuit elements being operably controlled by a bias current to control flow of RF current within the first and second conductive elements, wherein the path of the RF current is directed to be in substantially different locations within the first and second conductive elements.

In addition, a method for changing the electrical characteristics of an antenna in a communications system is provided, the antenna including a conductive element including a feed network coupled thereto. Circuit elements are coupled to the conductive element at predetermined positions. The circuit elements are adapted to control RF current flow in the conducting element, wherein the path of the RF current is directed to be in substantially different locations within the conductive element, the method comprising the steps of detecting that the antenna configuration should be changed, and modifying the RF characteristics of the antenna via the circuit elements.

Figure 1:
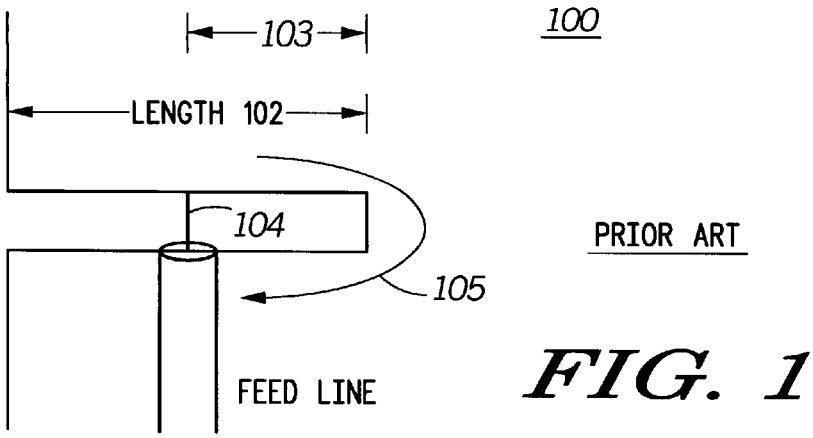
FIG. 1 generally depicts a prior art slot antenna.

With reference to FIG. 1, a prior art notch antenna 100 is shown. The notch antenna, typically implemented on a printed circuit or PC board, forms a resonator whose length 102 determines the resonant frequency. In the preferred embodiment, the length 102 is approximately $\lambda/4$. The resonator frequency can also be modified by incorporating dielectric material into the notch, modifying the length 102. The location of the feedpoint 104 sets the impedance of the resonator. The feedpoint of the resonator is located by a predetermined distance 103 from the edge of the notch. The radiation pattern of the antenna is characterized by the RF currents 105 that flow around the outside of the notch along the path provided by the conductor on the printed circuit board.

Figure 2:
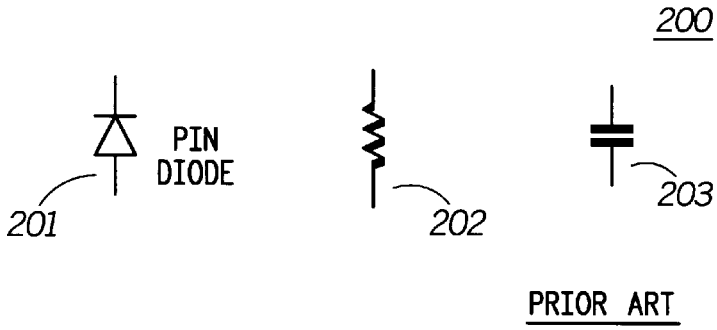
FIG. 2 generally depicts the characteristics of a PIN diode.

Referring now to FIG. 2, a prior art PIN diode 201 is shown, along with representations of the general characteristics of the PIN diode. When forward biased with a sufficient bias current, the effective impedance of the PIN diode is modeled as a low impedance, indicated by the resistor 202. The impedance may be very low such as a fraction of an ohm, and may be considered a short for the purposes of modeling its function in the antenna circuit. When the PIN diode 201 is reverse biased, the effective impedance is modeled by a very small capacitor 203 of a few pico-farad or less. It can be considered an open circuit for the purposes of modeling its function in the antenna circuit.

Figure 3:
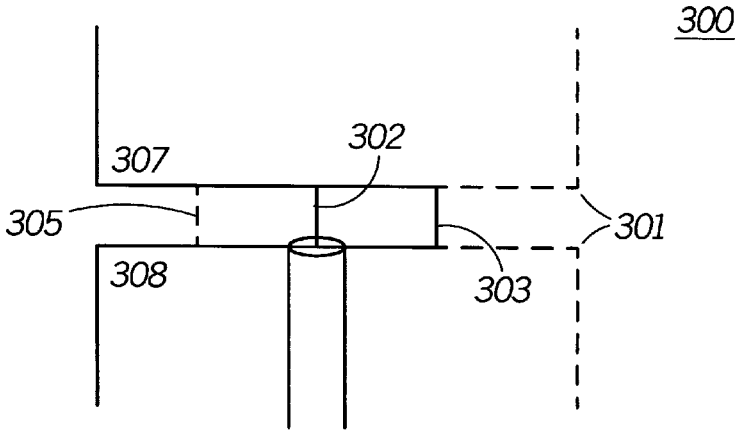
FIG. 3 generally depicts an embodiment of an antenna in accordance with the present invention.

Referring to FIG. 3, an embodiment of the present invention is formed by superimposing two mirrored images of the notch antenna shown in FIG. 1 in an overlapping fashion to essentially form two back to back notch antennas. Once implemented, the two notches form a continuous slot which may travel the length of the PC board, or any portion of the length of the PC board, thereby electrically separating the "two halves" of the PC board with insulator material 301 between the metal portions 307 and 308. The feed structure 302 is now in the center of the antenna, and in the preferred embodiment the elements around the feed structure are symmetric thereabout. Positions indicated by reference numerals 303 and 305 represent "virtual notches"—positions proximal the edge of the notch where circuit elements such as PIN diodes will be placed to emulate the open or short required to form a notch on one side or the other side of the structure. A dual band antenna may be formed using the same technique when the effective notch lengths, as determined by the locations of the circuit elements, are not identical or symmetrical. In this configuration, the antenna has a resonant frequency dependent on the state of the circuit elements.

Figure 4:
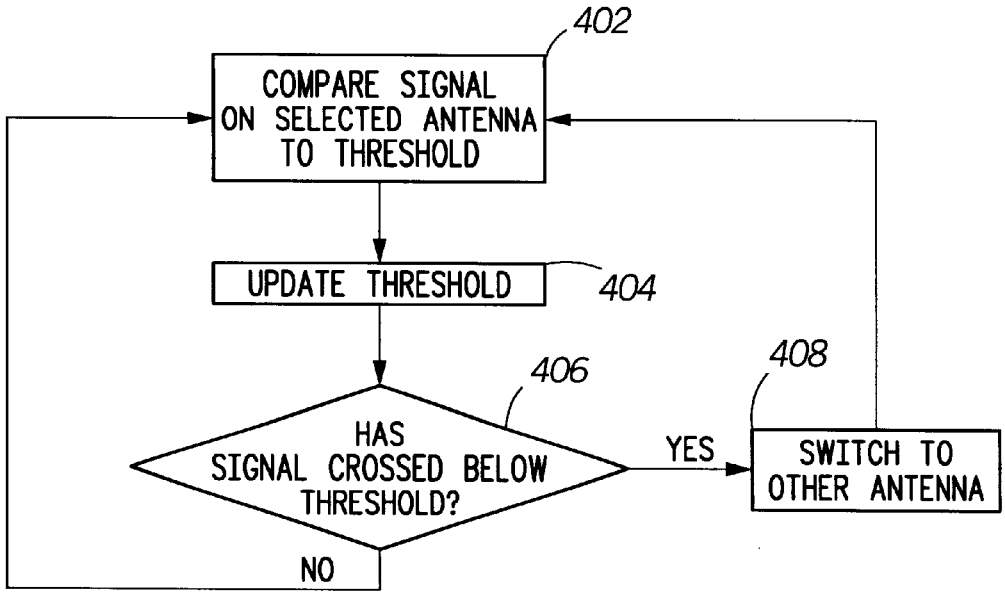
FIG. 4 generally depicts a switch and stay diversity technique.
Figure 5:
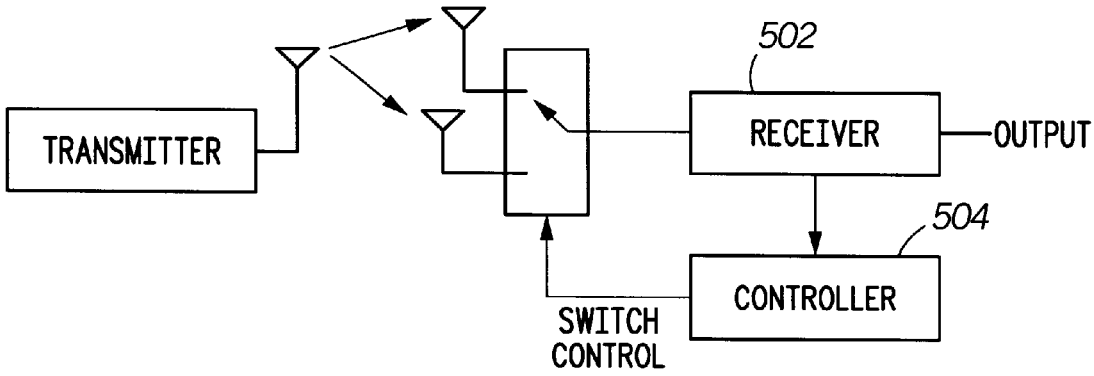
FIG. 5 generally depicts a switched diversity technique.

Referring to FIG. 4 and FIG. 5, many diversity techniques exist, including switched diversity, which is typically used when a single receiver is present, but more than one antenna. The switched diversity is accomplished by switching the signal presented to a receiver from either a first antenna or from a second antenna. Two techniques are common in the prior art to implement switched diversity. These are, switch and examine, and switch and stay. Switch and examine is an algorithm that switches between antennas based on received signal strength, and may at times switch back and forth very rapidly, particularly when both signals are faded below an average threshold value. The threshold is defined as the instantaneous signal level compared to the short term average, and it is usually measured in dB.

As seen in FIG. 4, the switch and stay approach simplifies this approach to simply switch when the present signal drops below a threshold. As shown in FIG. 4, the signal on the selected antenna is compared to the threshold at step 402, and the threshold is updated at step 404. At step 406, a determination is made whether the signal has dropped below the threshold. If one antenna signal is above the threshold, the switch and examine algorithm will keep this selection until it drops below the threshold and then switch to the other antenna as shown at step 408. As seen in FIG. 5, signal strength information is passed from the receiver 502 to the controller 504, where a comparison is made to the threshold. In the switch and stay embodiment, the control logic stays with the new antenna until that signal falls below the threshold. If the new signal is already below the threshold, the control logic will wait until the signal goes above the threshold and then falls below the threshold to switch between the antennas.

Figure 6:
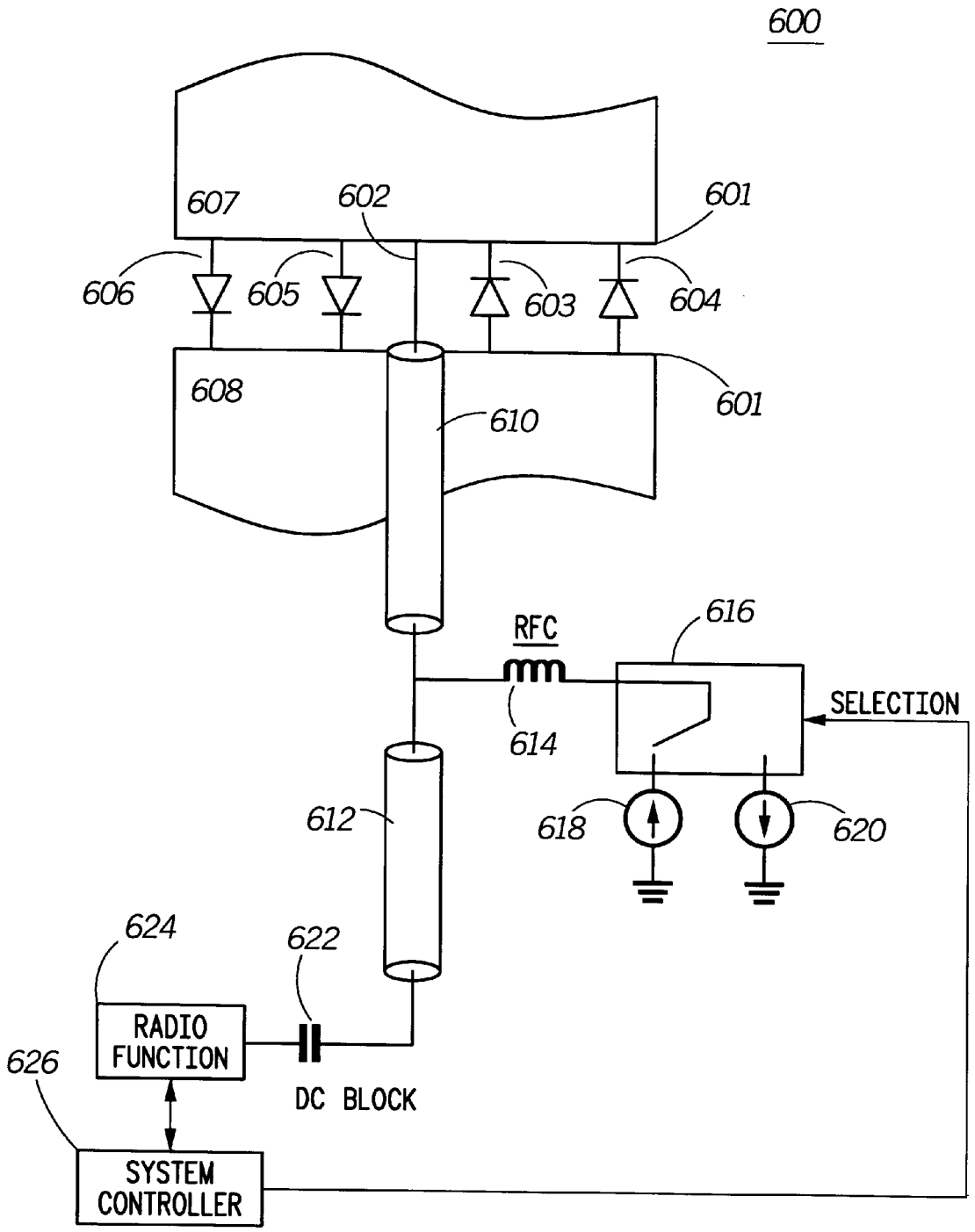
FIG. 6 generally depicts an embodiment of an antenna system in accordance with the present invention.

Referring to FIG. 6, a preferred embodiment of an antenna structure is shown with a slot 601 separating the two conducting portions 607 and 608. Pin diodes 603 and 605 are located in proximity to the edges of the "virtual slots" (positions 303 and 305 in FIG. 3) which were present in the separate structures. Since PIN diodes 603 and 605 are oriented in reverse from one another, when a positive bias current is provided, PIN diode 605 will act as a short, and PIN diode 603 will act as an open. When the bias current is reversed, PIN diode 605 will act as an open, and PIN diode 603 will act as a short. Pin diodes 604 and 606 are optional, and are used to enhance the emulation of the ground plane and improve the RF current flow in the circuit. From an RF point of view, RF currents will flow from the feed structure through the conductors along the slot, and through the PIN diode(s) that are forward biased, forming a complete path on one half of the board, or the other half. The operation of the circuit in this way effectively directs the flow of the RF currents through different parts of the circuit board, forming a spatially diverse antenna structure with a common conductor in the top and bottom half planes, and a common feed point. Further, the bias current conveniently selects and controls the RF current path to form a diversity function, allowing a single coax feed line to perform all needed functions for the antenna deployment. It will be appreciated by those skilled in the art that although PIN diodes are being described in the preferred embodiment, other circuit elements such as mechanical switches, FET switches, and relays may be used without departing from the spirit and scope of the present invention. In addition, although coaxial cable is described as a feed element, other feed element types, such as a microstrip, a stripline, and a coplanar waveguide may be used without departing from the spirit and scope of the present invention.

Feed structure 610 may be any convenient length to deploy the antenna, and for a fixed terminal, the length of this feed line may be several meters so that the antenna may be mounted in a window or other convenient place apart from the radio if desired. A positive or negative direct current (DC) bias 618 and 620 is used to supply bias current to the Pin diodes on the antenna structure. A radio frequency choke (RFC) 614 is used to isolate the bias current from the RF current in the feed structure. Switch 616 is used to switch between a transmitter and a receiver, and is controlled by system controller 626. The RF port selects the polarity of the bias current The radio function 624, which may include a receiver, a transmitter, or both, is shown in block 624. Radio function 624 is connected to a DC blocking capacitor 622 to isolate the RF circuits from the DC bias. Blocking capacitor 622 is connected to the feed structure 610 by coax 612.

While the invention has been particularly shown and described with reference to a particular embodiment, it will be understood by those skilled in the art that various changes in form and details may be made therein without departing from the spirit and scope of the invention. The corresponding structures, materials, acts and equivalents of all means or step plus function elements in the claims below are intended to include any structure, material, or acts for performing the functions in combination with other claimed elements as specifically claimed.

What we claim is:

1. An antenna, comprising:

a conductive element;

a feed element coupled to the conductive element;

circuit elements coupled to the conductive element at predetermined positions, the circuit elements adapted to control radio frequency (RF) current flow in the conductive element, wherein the path of the RF current is directed to be in substantially different physical locations within the conductive element; and a controller coupled to the circuit elements for selectively controlling RF current in the circuit elements to switch the path of the RF current, wherein switching the path of the RF current provides spatial diversity.

2. An antenna as recited in claim 1, wherein the positions of the circuit elements are selected to enhance antenna performance at desired RF frequencies, and switch between RF current paths, selected to operate at substantially the same frequency, for providing spatial diversity.

3. An antenna as recited in claim 2, wherein the antenna is a diversity antenna.

4. An antenna as recited in claim 1, wherein the circuit elements are controlled through the feed element.

5. An antenna as recited in claim 1, wherein the circuit elements comprise one of a pin diode, a relay, a FET switch, and a mechanical switch.

6. An antenna, comprising:

a first conductive portion and a second conductive portion, the first and second conductive portions being separated and insulated from each other by a slot, the slot having a length;

a feed element coupled to the first and second conductive portions; and circuit elements coupled between the first and second conductive portions, the circuit elements being operably controlled by a bias current to control flow of RF current within the first and second conductive elements, wherein the path of the RF current is directed to be in substantially different locations within the first and second conductive elements to provide spatial diversity.

7. An antenna as recited in claim 6, wherein the positions of the circuit elements are selected to enhance antenna performance at desired RF frequencies, and switch between RF current paths, selected to operate at substantially the same frequency, for providing spatial diversity.

8. An antenna as recited in claim 7, wherein the antenna is a diversity antenna.

9. An antenna as recited in claim 6, wherein the circuit elements are controlled through the feed network.

10. An antenna as recited in claim 6, wherein the circuit elements comprise one of a pin diode, a relay, a FET switch, and a mechanical switch.

11. An antenna as recited in claim 6, wherein a dielectric material is incorporated within the slot to modify the slot length.

12. A method for changing the electrical characteristics of an antenna in a communications system, the antenna comprising a conductive element including a feed element coupled thereto, the antenna further comprising circuit elements coupled to the conductive element at predetermined positions, the circuit elements adapted to control RF current flow in the conducting element, wherein the path of the RF current is directed to be in substantially different locations within the conductive element, the method comprising the steps of:

detecting that the antenna configuration should be changed for providing spatial diversity; and changing the path of the RF current flow in the conductive element of the antenna via the circuit elements to provide spatial diversity.

13. A method as recited in claim 12, wherein the detecting step comprises the step of determining the need to direct the RF current within the conducting element.

14. A method as recited in claim 12, wherein the changing step comprises the step of determining the need to redirect the RF current within the conducting element.

15. A method as recited in claim 12, including the step of controlling the circuit elements through the feed network.

* * * * *